US007499828B2

(12) United States Patent
Barton et al.

(10) Patent No.: US 7,499,828 B2
(45) Date of Patent: Mar. 3, 2009

(54) POSITION DETERMINING APPARATUS AND RELATED METHOD

(76) Inventors: Mario Barton, 500 Forest Highland, Flagstaff, AZ (US) 86001; Marius Filmalter, 4101 Custer Rd., McKinney, TX (US) 75070; Eric Cramer, 2704 Bosque del Rio La. NW., Albuquerque, NM (US) 87120; Dave Fugelso, 8415 Fairmont Dr. NW., Albuquerque, NM (US) 87120; David Cremer, 7127 Modesto NE., Albuquerque, NM (US) 87122; Kyle Langenwalter, 100 Sun Ave. NE., Suite 500, Albuquerque, NM (US) 87109; Brian Murphy, 6908 Bellrose NE., Albuquerque, NM (US) 87110; Richard Theriault, 9 Meriam St. #5, Lexington, MA (US) 02420; Evan McGee, 17 City Views Rd., Brookline, MA (US) 02446

( * ) Notice: Subject to any disclaimer, the term of this patent is extended or adjusted under 35 U.S.C. 154(b) by 0 days.

(21) Appl. No.: 11/606,248

(22) Filed: Nov. 29, 2006

(65) Prior Publication Data

US 2007/0265105 A1 Nov. 15, 2007

Related U.S. Application Data

(60) Provisional application No. 60/740,591, filed on Nov. 29, 2005.

(51) Int. Cl.
*G06F 15/00* (2006.01)
*G05D 1/02* (2006.01)

(52) U.S. Cl. ..... 702/150; 473/220

(58) Field of Classification Search ..... 702/94, 702/150, 152, 159; 473/220; 345/156
See application file for complete search history.

(56) References Cited

U.S. PATENT DOCUMENTS

| | | | | |
|---|---|---|---|---|
| 5,227,985 | A | | 7/1993 | DeMenthon |
| 5,692,965 | A | * | 12/1997 | Nighan et al. ..... 473/220 |
| 5,800,263 | A | * | 9/1998 | Hayashida et al. ..... 463/6 |
| 5,874,942 | A | * | 2/1999 | Walker ..... 345/158 |
| 6,665,079 | B1 | | 12/2003 | Tocci et al. |

FOREIGN PATENT DOCUMENTS

WO WO/2005/094949 10/2005

OTHER PUBLICATIONS

U.S. Appl. No. 10/954,711, filed Sep. 29, 2005, Marquardt, Christian.

* cited by examiner

*Primary Examiner*—Bryan Bui
(74) *Attorney, Agent, or Firm*—J. Mark Holland and Associates; J. Mark Holland

(57) ABSTRACT

A system for determining the relative displacement of a rigid object is described herein. In one embodiment, the system includes three data sources positioned on an object. The data sources are configured to transmit data relating to positional displacement of the object. Each data source has predefined movement parameters based on the position of each data source on the object. In one embodiment, the system further includes a receiver unit configured to display positional information relating to the object based on the data received from each data source. The positional information represents a single valid solution set generated in part by eliminating positional movements that exceed the predefined movement parameters.

4 Claims, 15 Drawing Sheets

POSITION DETERMINING APPARATUS AND RELATED METHOD

CROSS-REFERENCE TO RELATED APPLICATION

This application claims priority to U.S. provisional application Ser. No. 60/740,591 filed Nov. 29, 2005, the contents of which is incorporated herein by reference in its entirety.

FIELD OF THE INVENTION

The apparatus described herein generally relates to a system for determining the relative position of a rigid object, and more particularly for monitoring, analyzing, and reporting the relative displacement of an object based on predefined location and movement parameters assigned to three positional transmitting sources attached to the object.

BACKGROUND OF THE INVENTION

A wide variety of golf swing-analysis technologies exist. The most common method used these days both by amateurs and professionals to view and analyze a swing is a software program used in conjunction with a digital video camera and a computer. Most of the swing-analysis software sold today can be downloaded over high-speed Internet connections. Like many software programs on the market, a user's swing is taped and the image is downloaded onto a computer, where it is then analyzed with interface overlays.

Relatively more advanced technologies combine swing-analysis software with hardware such as infrared trackers, gyroscopes, and accelerometers embedded in or placed upon a golf club, user's vest or body, or similar apparatus which permit data to be collected with or without the use of a camera. The data may then be stored in computer memory, and processed and analyzed by the associated software for training purposes.

An example of such technology is the "Super Accurate Measurement" (SAM) system, a swing-analysis tool developed by Science and Motion GmbH of Germany, that includes a MotionAnalyzer (hardware) and PuttWare (software) to evaluate putt strokes. The SAM system uses ultrasound transmissions on four channels to track the position of the putter in three-dimensions (3D) throughout the stroke to generate data on 28 different movement parameters for swing duration, timing, velocity and acceleration, club face alignment at address, club head rotation, swing path direction and impact spot on the club face.

In the SAM system, a sensor triplet transmitter is attached to a putter shaft and is calibrated in seconds to a tripod mounted stationary receiver, which feeds the registered data into a software program via a USB interface for analysis, storage, and reporting on either a television or computer screen, or a printer.

The measuring principle is based on measuring the travel time needed by each of the three senders on the sensor triplet to reach the microphones in the measuring unit. These time periods are then used to calculate, using specific algorithms, the sensors' position in space, which make it possible to derive the movement data.

The SAM software generates feedback in the form of graphic reports of the stroke, and compares the player's stroke to a databank of strokes. Training, using feedback of the SAM, addresses specific stroke flaws for motor learning.

SUMMARY OF THE INVENTION

For the purpose of summarizing the invention certain objects and advantages have been described herein. It is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

The apparatus described herein can generally be thought of as a system for monitoring, analyzing, and reporting the position and orientation of a rigid object in space. Although developed primarily as a wireless, portable, and cost effective, golf-putting motion instructor or golf swing analysis tool, persons of ordinary skill in the art will understand that the apparatus and methods described herein may have other useful applications where real-time feedback for the position and orientation of an object in space is desired. Such applications may include other sporting activities such as tennis, baseball, hockey, fencing, etc.

Generally, the system includes three data sources positioned on an object. The data sources are configured to transmit data relating to the positional displacement of the object. Each data source has predefined movement parameters based on the position of each data source on the object. The system further includes a receiver unit for receiving the data relating to positional displacement from each data source, and a processing means for processing the data to provide positional information representing a single valid solution set generated in part by eliminating positional movements that exceed the predefined parameters.

In one embodiment, the receiver is configured to display the valid solution set for the purpose of at least stroke analysis. In another embodiment, viewing of the valid solution set may be accomplished by use of a computer monitor, television, or other similar device.

In one specific application, the system utilizes positional data capture techniques to determine the relative displacement of a golf club (putter) based on predefined location and movement parameters assigned to three light emitting sources, preferably LEDs, removably attached to the club. Through unique positioning of the LEDs having predefined or restricted movement parameters, i.e., those within a predetermined boundary set, the system is able to eliminated ambiguous solution sets that exceed those predefined movement parameters/limitations using reduction algorithms to arrive at a single valid solution set relating to the positional displacement of the club.

The apparatus tracks and records the motion and angle of a golf-putter in three-dimensional (3D) space from backstroke, to impact, to follow-through. Processing means such as software control of computer hardware (including the microprocessor, various temporary and permanent memory storage devices, shift registers, and the like) is used to determine club position by transforming projected LED data locations in the camera image to 3D coordinates using, among other things, reduction algorithms to eliminate ambiguity in positional data sets. A microprocessor converts the data collected relating to a variety of stroke parameters into a format suitable for viewing on a touch screen display.

Preferably, the system includes a uniquely constructed motion reflector clip or transmitter unit having 3 battery powered infrared (IR) light emitting diodes (LEDs) for transmitting data/information in the form of light relating to club position; a system motion sensor or receiver unit having a camera to collect the data from the LEDs, and various hardware elements such as filters, memory, microprocessor, etc., for collecting, storing, analyzing, manipulating, and distributing the data; and software elements for controlling specific hardware elements and generating interface display reports and graphical information for swing-analysis viewing.

These and other embodiments will become readily apparent to those skilled in the art from the following detailed description of the preferred embodiments having reference to the attached figures, the invention not being limited to any particular preferred embodiment(s) disclosed.

DETAILED DESCRIPTION

Figure 1A:
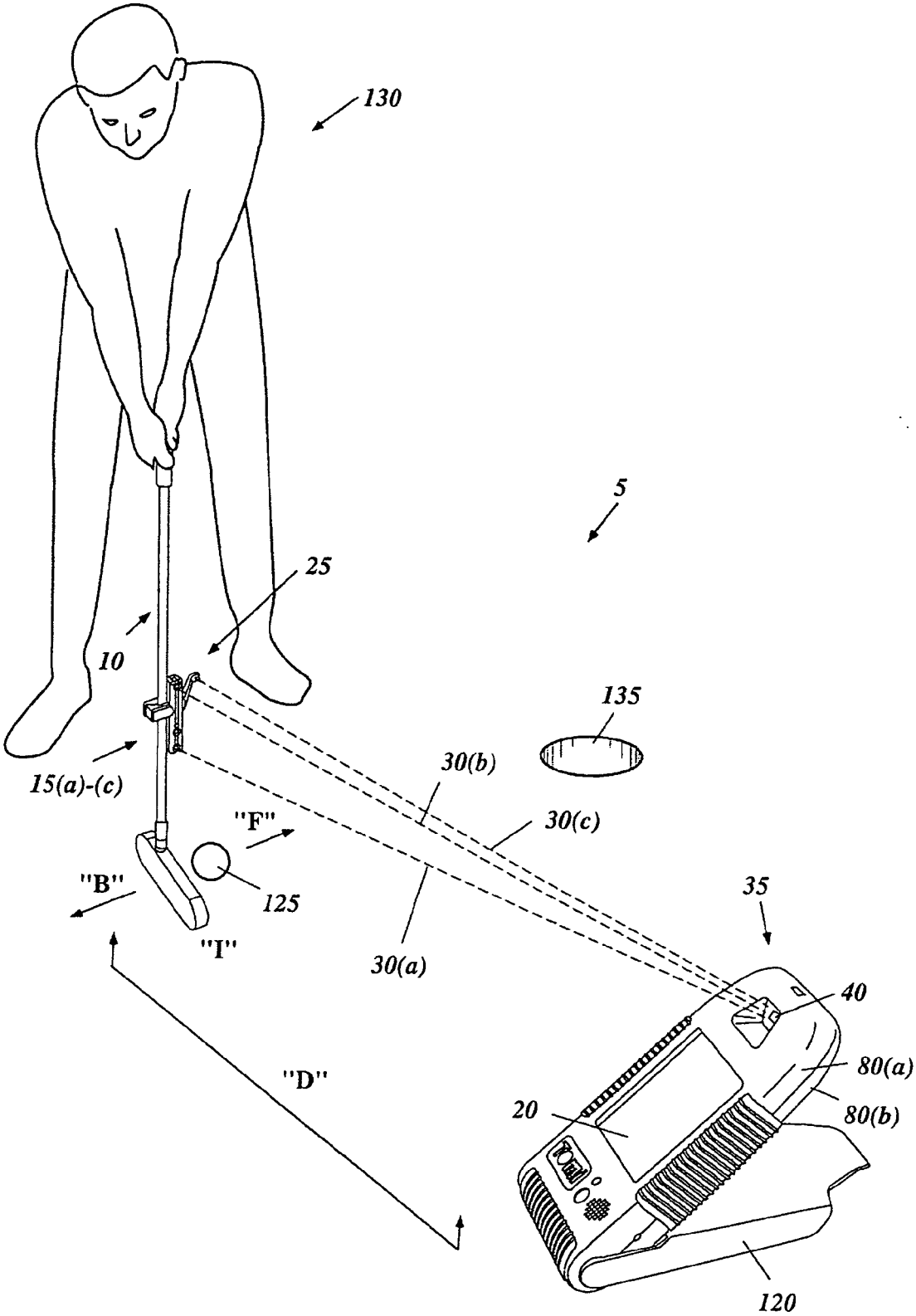
FIG. 1A generally shows the position determining apparatus including a transmitting unit and a receiver unit as it may be used in the context of a golf swing analysis tool.

Embodiments of the present invention will now be described with references to the accompanying Figures, wherein like reference numerals refer to like elements throughout. The terminology used in the description presented herein is not intended to be interpreted in any limited or restrictive manner, simply because it is being utilized in conjunction with a detailed description of certain embodiments of the invention. Furthermore, various embodiments of the invention (whether or not specifically described herein) may include novel features, no single one of which is solely responsible for its desirable attributes or which is essential to practicing the invention.

The detail description herein focuses primarily on the system's use as it may apply in one embodiment of a golf swing-analysis tool, and more particularly, to its application in a golf-putting motion instructor. Persons of ordinary skill in the art will understand that other applications of the invention are equally applicable. Such applications may include other sporting activities such as tennis, baseball, hockey, fencing, etc.

The system 5, based on "Machine Vision Robotics Technology", utilizes positional data capture techniques to determine the relative displacement of a golf club 10 based on predefined or restricted location and movement parameters assigned to three data sources 15(*a*)-(*c*), preferably light emitting diodes (LEDs), removably attached to the club 10. Through unique positioning of the LEDs 15(*a*)-(*c*) having predefined movement parameters, i.e., those within a restricted boundary set, the system 5, using a processing means such as software, can control computer hardware and determine club position by transforming projected LED data locations in the camera image to 3D coordinates using, among other things, reduction algorithms to eliminate ambiguity in positional data sets that exceed those predefined movement parameters/limitations to arrive at a single valid solution set representing the positional displacement of the club 10.

Persons of ordinary skill in the art will understand that other data sources such as gyroscopes, electrometers, and the like may be utilized with or in place of the LEDs. In this regard, as with the LEDs, each data source would have predefined movement parameters, i.e., those within a restricted boundary set such that a reduction algorithm may be utilized to eliminate ambiguity in positional data sets that exceed those predefined movement parameters/limitations to arrive at a single valid solution set representing the positional displacement of the club.

In one embodiment, the apparatus or optimal motion instructor system (TOMI™) 5 tracks and records the motion and angle of a golf-putter 10 in three-dimensional (3D) space from backstroke, to impact, to follow-through as represented by reference letters "B", "I", and "F" respectfully in FIG. 1A. Determination of club position is based on transforming projected LED data locations in the camera image to 3D coordinates. A processing means such as a microprocessor converts the data collected relating to a variety of stroke parameters (physical attributes of the golf stroke including club head speed/velocity and rotation, alignment at address, alignment and loft at impact, and forward and backward stroke path) into reports and/or graphical feedback capable of being displayed on a touch control high-resolution screen 20.

As shown at least in FIGS. 1A, 1B, 2A, and 2B, in one embodiment, the system preferably includes a motion reflector clip or transmitter unit 25 having 3 battery powered infrared (IR) light emitting diodes (LEDs) 15(*a*)-(*c*) for transmitting data/information in the form of light 30(*a*)-(*c*) relating to club position; a system motion sensor or receiver unit 35 preferably having a camera 40 to collect the data 30(*a*)-(*c*) from the LEDs 15(*a*)-(*c*), and various hardware elements such as filters, memory, microprocessor, etc., for collecting; storing; analyzing, manipulating, or otherwise processing; and distributing the data; and software elements for controlling specific hardware elements and generating interface display reports and graphical information for swing-analysis viewing (see FIGS. 9-12).

Figure 13:
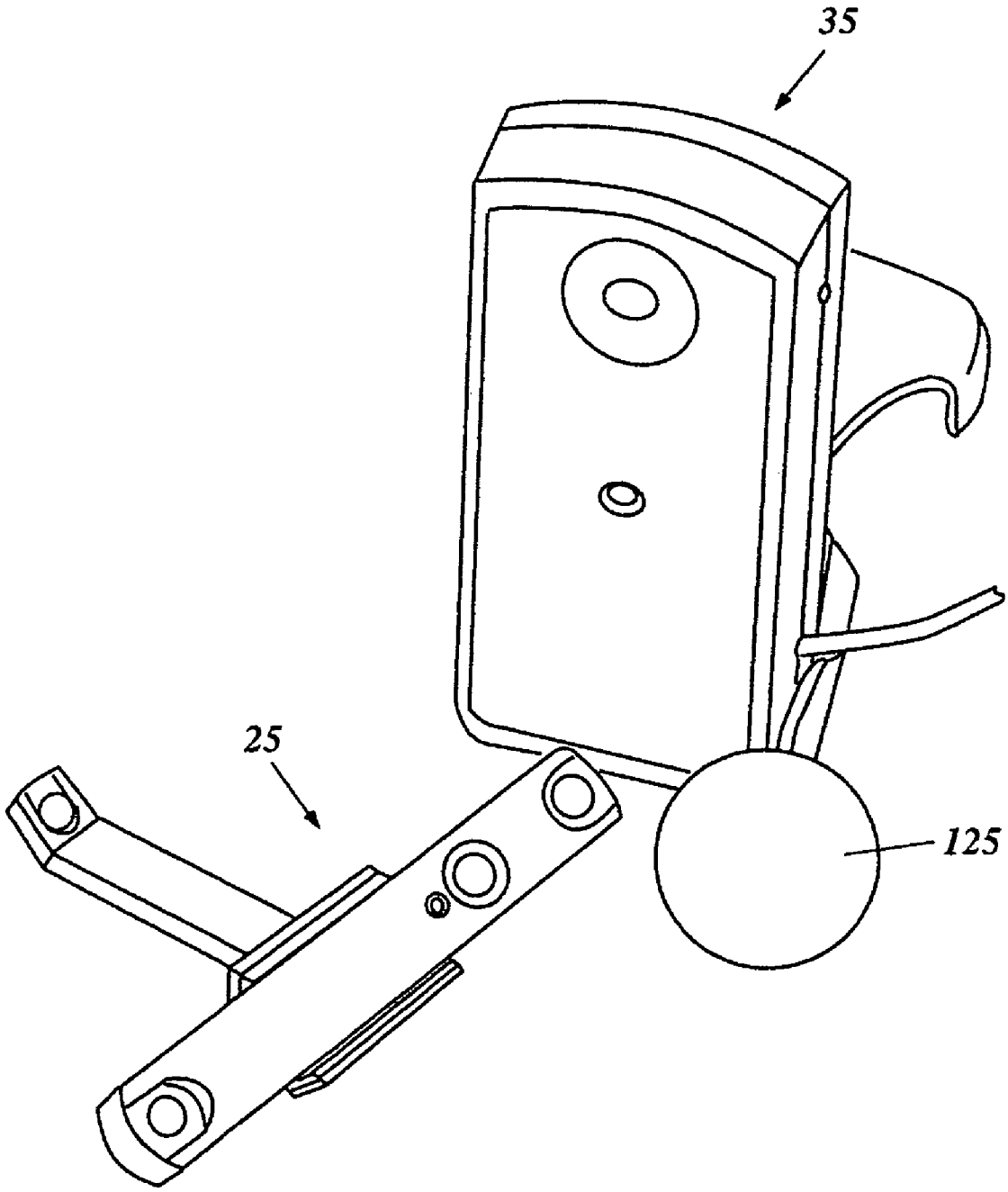
FIGS. 13-14 shown alternative embodiments of the transmitter and receiver units.
Figure 14:
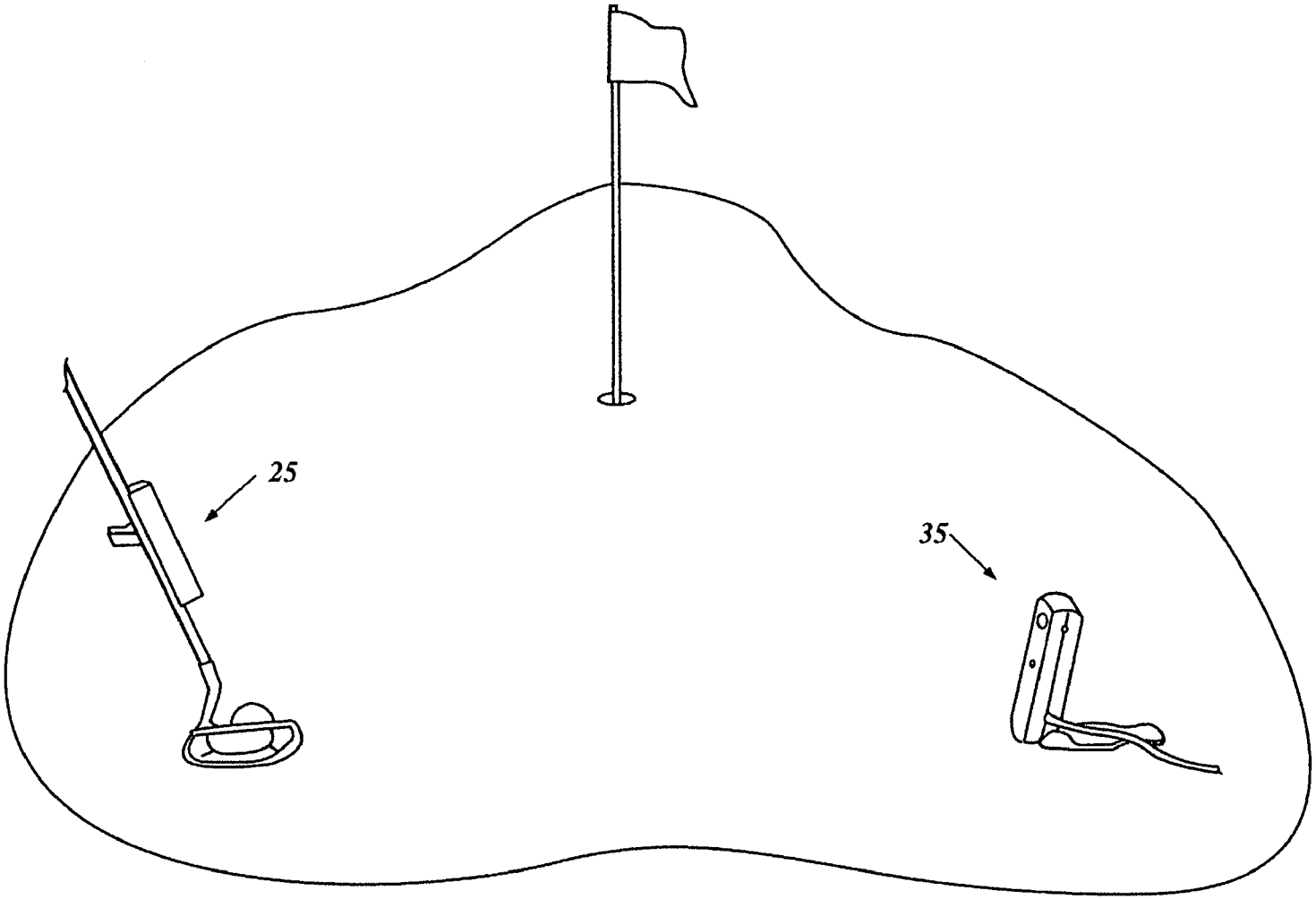

In an alternative embodiment shown in FIGS. 13 and 14, some or all of the various hardware elements such as filters, memory, microprocessor, etc., for collecting; storing; analyzing, manipulating, or otherwise processing; and distributing the data; and software elements for controlling specific hardware elements and generating interface display reports and graphical information for swing-analysis viewing may be done by a device other than the receiver unit 35. Such remote device(s) may include a computer system and/or monitor, television, PDA, or similar type of device.

As shown in FIGS. 1A, 1B, 2C, and 2E, the transmitter unit 25 is preferably removably attached to the club (putter) 10 approximately 10 inches above the putter face 45 along the club shaft 50 by a friction clip 55. As shown in at least FIGS. 2D and 2E, a knob/screw adjustment 60 may be used to removably attach or secure the transmitter 25 to the putter shaft 50.

Figure 2A:
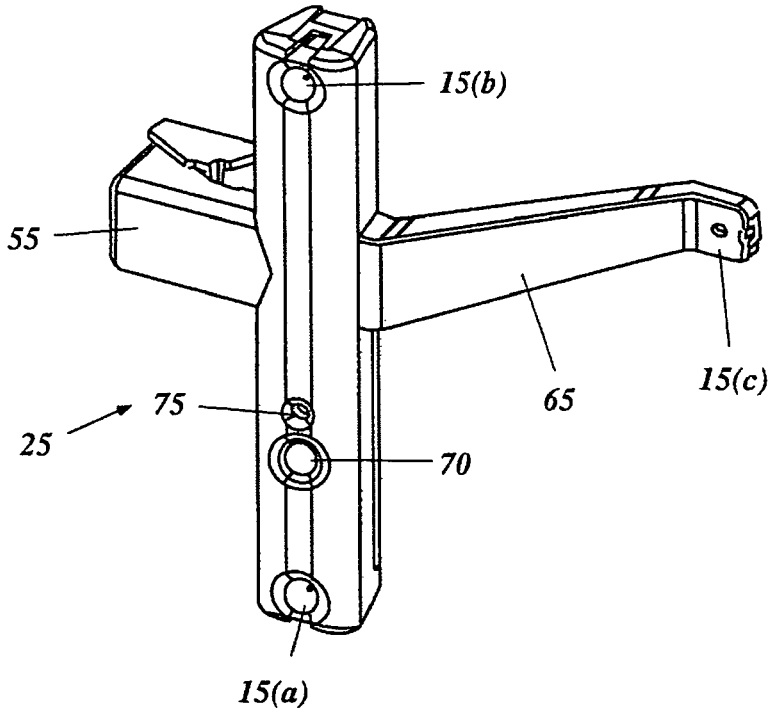
FIGS. 2(A)-(E) show various views of the transmitter unit shown in FIGS. 1A-1B, as well as, the unit's attachment to an object, such as a golf club, for the transmission of data relating to the position of the object.
Figure 2B:
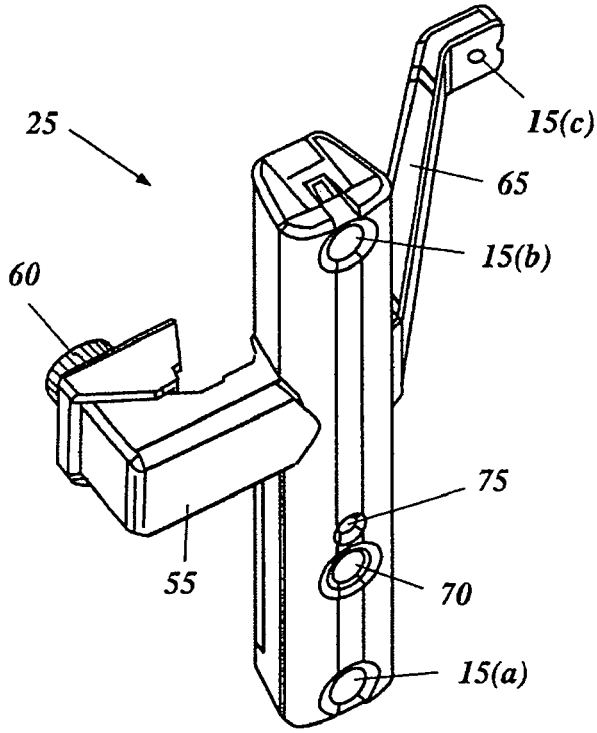
Figure 2C:
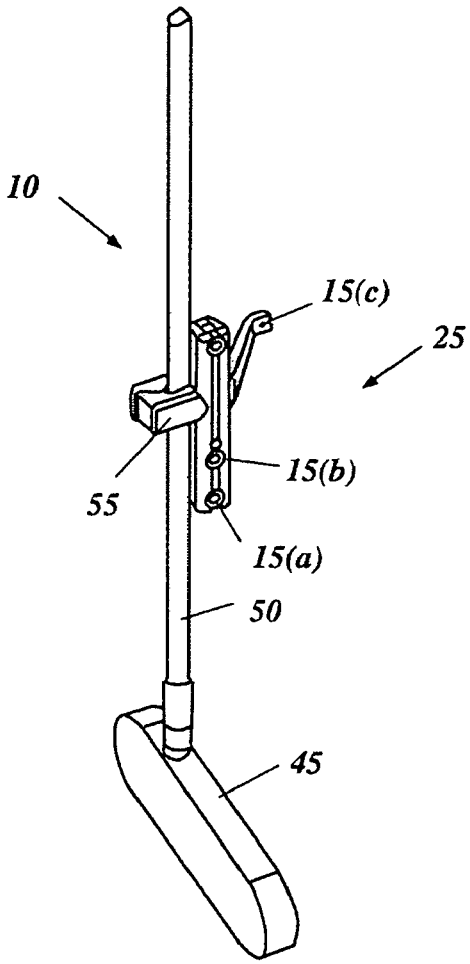
Figure 2D:
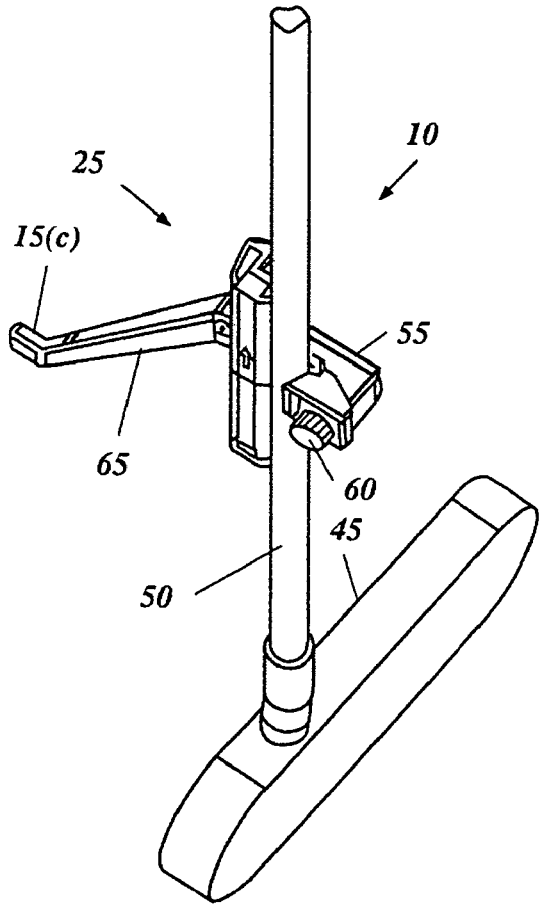
Figure 2E:
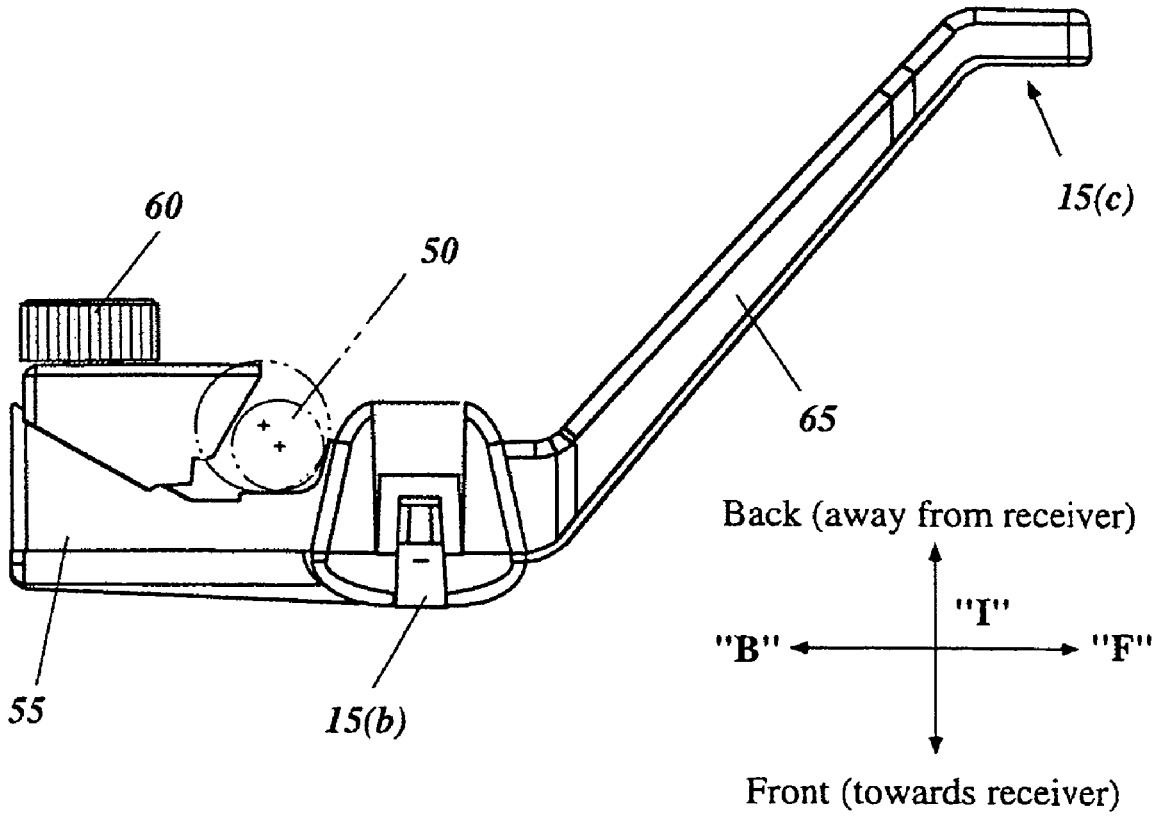

As indicated above, preferably, the transmitter unit 25 includes 3 battery powered IR LEDs 15(*a*)-(*c*). In one embodiment, two "AAA" batteries housed within the transmitter 25 power the LEDs 15(*a*)-(*c*). As shown in FIGS. 2A, 2B, and 2E the first two LEDs 15(*a*)-(*b*) are positioned generally horizontal to each other along the shaft 50 of the putter 10 while the third LED 15(*c*) is placed on an arm 65 that extends outward and behind the other two LEDs (15)-(*b*) and putter shaft 50. The LED 15(*a*)-(*c*) arrangement coupled with predefined movement parameters/boundaries, as described in more detail below, solves at least in part the issue of ambiguous solution sets associated with determining the positional identity of a three-point source in 3D.

Preferably, the transmitter unit 25 further includes an on/off switch 70 to provide or disconnect power (controlled illumination) to each of the LEDs 15(*a*)-(*c*). A power indicator light 75 may be further provided to show transmitter unit status. Electrical connectivity between the batteries, the power switch 70, and the LEDs 15(*a*)-(*c*), which permits positional data/signal emissions in the form of light 30(*a*)-(*c*) from each of the LEDs 15(*a*)-(*c*), is well known in the art. The positional data 30(*a*)-(*c*) emitted/transmitted from each LED 15(*a*)-(*c*) is captured using a camera 40 disposed in a base housing [top and bottom halves 80(*a*)-(*b*)] of the receiver 35.

Figure 1B:
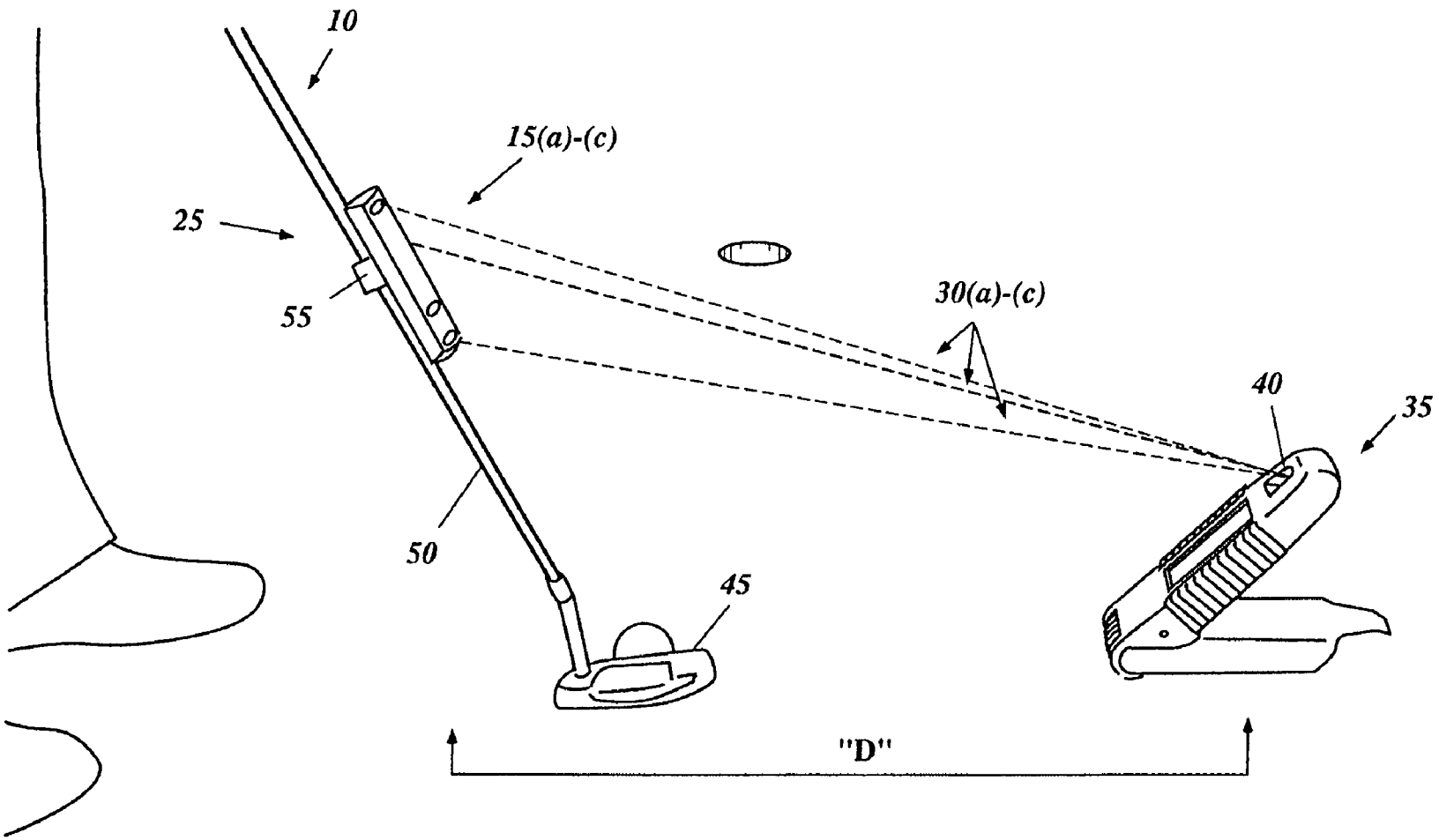
FIG. 1B shows the position determining apparatus of FIG. 1A and one alignment or position relationship between the transmitter unit and receiver unit used for receiving signal transmissions by the receiver from the transmitter and viewing of information on the receiver's interface display.

In this regard, as shown in FIGS. 1A and 1B, the receiver unit 35 is preferably positioned about 2-4 feet from the transmitter unit 25, as represented by reference letter "D". Persons of skill in the art will understand that the exact position and distance "D" between the transmitter and receiver units 25, 35 may vary, so long as the alignment and distance "D" is adequate for receiving signal transmissions by the receiver 35 from the transmitter 25, and for preferably viewing of the information relating to swing-analysis on the receiver's interface display 20.

Figure 3:
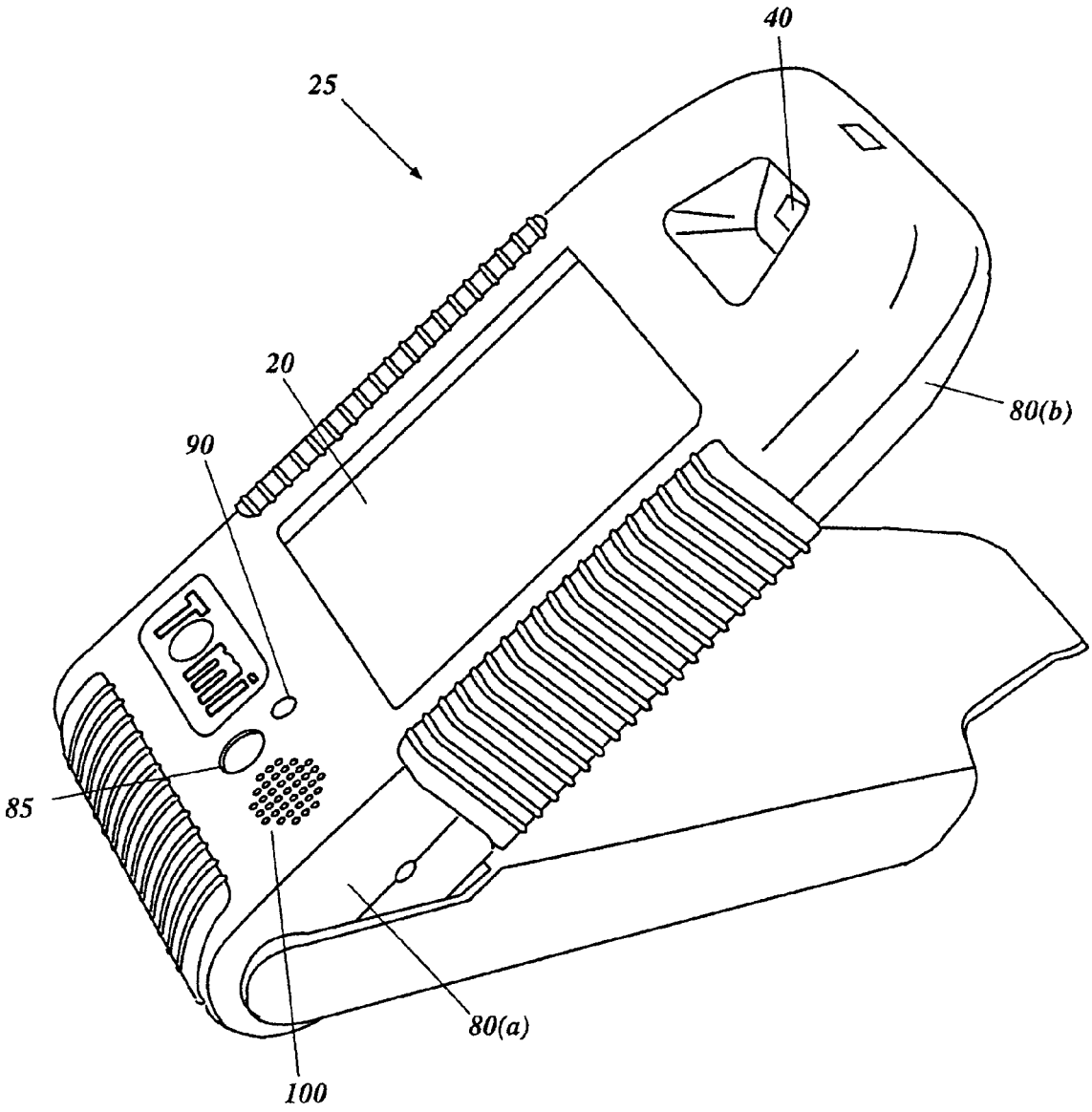
FIG. 3 shows a perspective view of one embodiment of the receiver shown in FIGS. 1A-1B.
Figure 4:
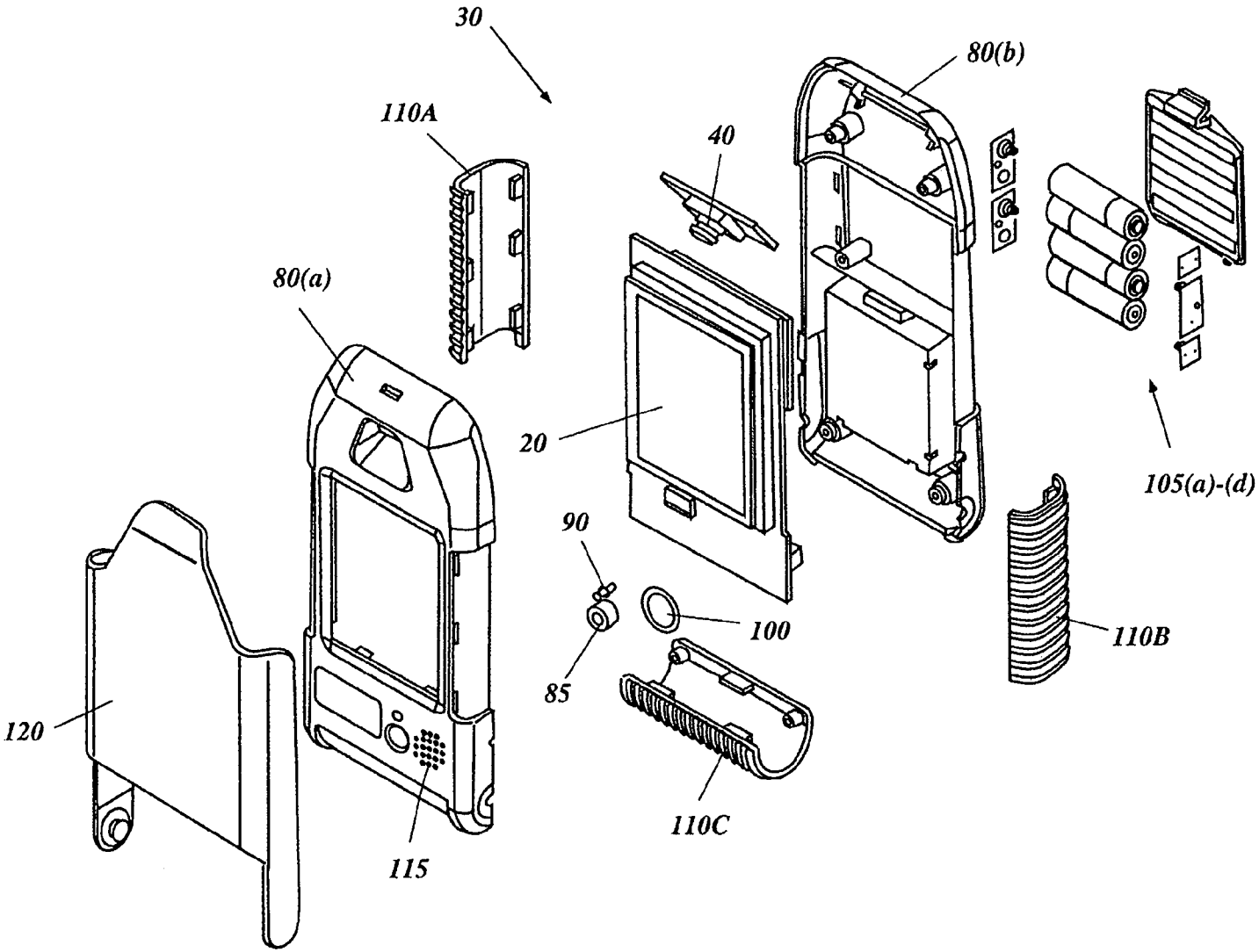
FIG. 4 is an exploded view of one embodiment of the receiver shown in FIG. 3.

As shown in FIGS. 3 and 4, the receiving unit 25 is preferably only slightly larger than a personal digital assistant (PDA). As indicated and described herein, the receiving unit 25 includes an optical receptor such as a camera 40 disposed in the base housing 80(*a*)-(*b*), and positioned and configured to receive data (light) transmitted wirelessly from the receiver's LEDs 15(*a*)-(*c*). Preferably, such a camera 40 is digital, includes charged coupled device (CCD) image sensor capabilities, an IR filter, a 60 degree field of view, and samples at approximately 30 frames/second (fps). Preferably, an on/off switch 85 to provide or disconnect power, a power indicator light 90 to show camera and/or receiver status, a high-resolution touch control interface LCD screen display 20, and speaker 100 is further provided. Four "AA" batteries 105(*a*)-(*d*) preferably supply power to the receiver unit 35.

Other features of the receiver unit 35 may include handgrips 110A, 110B, and 110C, and a USB port (not shown) for communication connectivity to corresponding peripherals such as a computer, a display monitor, or other associated equipment. A speaker 115 for sound propagation, a hinged rotatable cover/stand combination 120 for positioning of the receiver 35 and protection of the receiver's display 20, and a direct-current (DC) input for connection of an alternative power source, may be further provided.

FIG. 4, an exploded view of one embodiment of the receiver unit 35, shows relative positioning and structural connectivity of various receiver components including a system's operating housing 125 that essentially contains a mini computer system having memory capable of temporary and/or permanent storage for at least a software control program, a processing means such as a central processor unit "single board computer", and other related hardware and the associated connectivity to facilitate the collection, storage, analysis, manipulation, processing, and distribution of data received from the transmitter unit 25. Access to such inner components may be facilitated by a clip cover that permits separation between a base housing front face plate 80(*a*) and a base housing back face plate 80(*b*).

Preferably, the transmitter and receiver units 25, 35 are constructed from materials such as injection-molded plastic (base housing and transmitter), metal (screws and related connectors), rubber (handgrips, gaskets and seals), etc., so as to provide a generally reliable working apparatus when exposed to shock and environmental conditions such as sun, water, wind, sand, etc. Material construction of other elements, such as the LEDs, camera, and batteries, is well known in the art.

As described herein, the process of object position determination in the context of a golf swing preferably begins by attaching the transmitter 25 on the club shaft 50 approximately 10 inches from the club face 45 and placing the receiver 35 approximately 2-4 feet from the transmitter 25. In this regard the combination of club shaft 50 and transmitter 25 act as a pendulum. Accordingly, a transmitter 25 placed lower on the club shaft 50 will have a greater velocity when compared to a higher placed transmitter 25. Persons of ordinary skill in the art will understand that, although related to angular velocity, the exact height placement of the transmitter on the shaft is not critical so long as it remains constant throughout the training session in order to produce repeatable results.

Both the transmitter and receiver units 25, 35 are powered-up and positioned to allow light/data transmission between the transmitter and receiver 25, 35. A person using the system preferably touches an appropriate touch screen control (see FIGS. 9-12) such as "Capture" to begin image acquisition by the camera 40. With putter 10 in hand (FIG. 1A), a person 130 (golfer) addresses a golf ball 125 and remains stationary in his/her normal golf stance "point of address" for approximately 200 milliseconds.

In one embodiment, hole alignment at the "point of address" is unnecessary. Using relative positioning verses absolute positioning, which requires a more complex system set-up to account for exact hole placement, the stroke analysis system 5 described herein assumes the golfer 130 is properly aligned with the hole 135. In another embodiment, a second camera or another light source may be employed to determine absolute position.

The system 5 is programmed to capture right-handed putting strokes. However, persons of ordinary skill in the art will understand that software upgrades may be provided that recalibrate the system to capture both right and left handed putt strokes. Preferably, upgrades of this type or similar type upgrades are made available from a web server for downloading to a personal computer, and transfer from the computer to the receiver unit via the USB connection.

Figure 6:
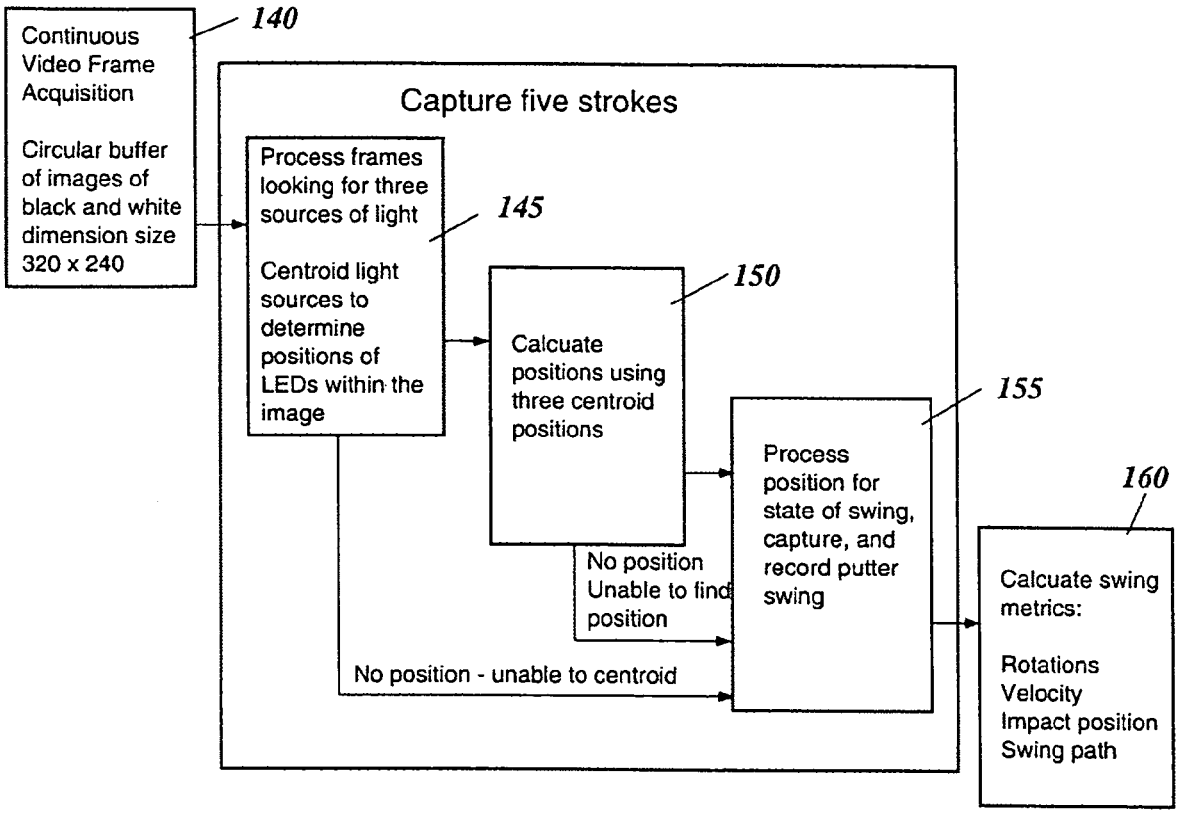
FIG. 6 shows one data capture and processing routine for swing related information preformed by the receiver unit.

As shown in FIG. 6, the system is designed to capture five putting strokes from a continuous running digital video camera 40. As explained in more detail below, the program captures a stroke when a position is acquired and held still for a period of time, then pulled back for the backstroke "B". The position where the putter 10 is held still is stored as the address position. Subsequent positions are stored until the putter passes through the address point (typically point "I" shown in FIG. 1A) and stops moving in direction "F".

For each putt stroke, IR light continuously transmitted from each LED 15(*a*)-(*c*), is received, collected, filtered and/or sampled by camera video frame acquisition at a preferred rate of 30 fps (reference step 140). The system filters out visible light so as to retain only the IR element representing each LED, and processes the frames looking for those three sources of light representing each LED (reference step 145). Due to LED image brightness occupying many pixels, centroid light source techniques well known in the art determine the approximate center position of the LEDs within a frame image (reference step 150).

In this regard, the centroiding function locates the three LED pixel centroids based on the parameter size and centroid threshold. Generally, the centroid algorithm is as follows:

1. Search image stepping by columns of size/3 and rows/3.
2. Find a pixel over the threshold value.
3. Find all pixels over the threshold within the size dimensions.
4. For all rows in the centroid area, sum the row and calculate a weighted average to determine the Y center of the centroid.
5. For all columns in the centroid, sum each column and calculate a weighted average to determine the centroid X position.
6. Eliminate the centroid area from the search.
7. Repeat until three centroids are found.
8. Order the centroids so that centroid one is generally located at bottom left, centroid two is generally located at top left, and centroid three is generally located furthers right.

This process is illustrated mathematically below.

$$T = \sum_{I=StartRow}^{EndRow} \sum_{j=StartColumn}^{EndColumn} PixelValue_{ij}$$

$$X\text{centroid} = \sum_{i=StartColumn}^{EndColumn} i \cdot \left( \sum_{j=StartRow}^{EndRow} PixelValue_{ij} \right) / T$$

$$Y\text{centroid} = \sum_{i=StartRow}^{EndRow} i \cdot \left( \sum_{j=StartColumn}^{EndColumn} PixelValue_{ij} \right) / T$$

For camera calibration, pixel values are translated into real word values based on a calibration coefficient and distance from the camera. Equations representative of this process are provided below.

$$X = X_{pixel} \cdot Z / Tx$$

$$Y = Y_{pixel} \cdot Z / Ty$$

Tx and Ty are measured values and set in the constructor for the centroid class.

Figure 7:
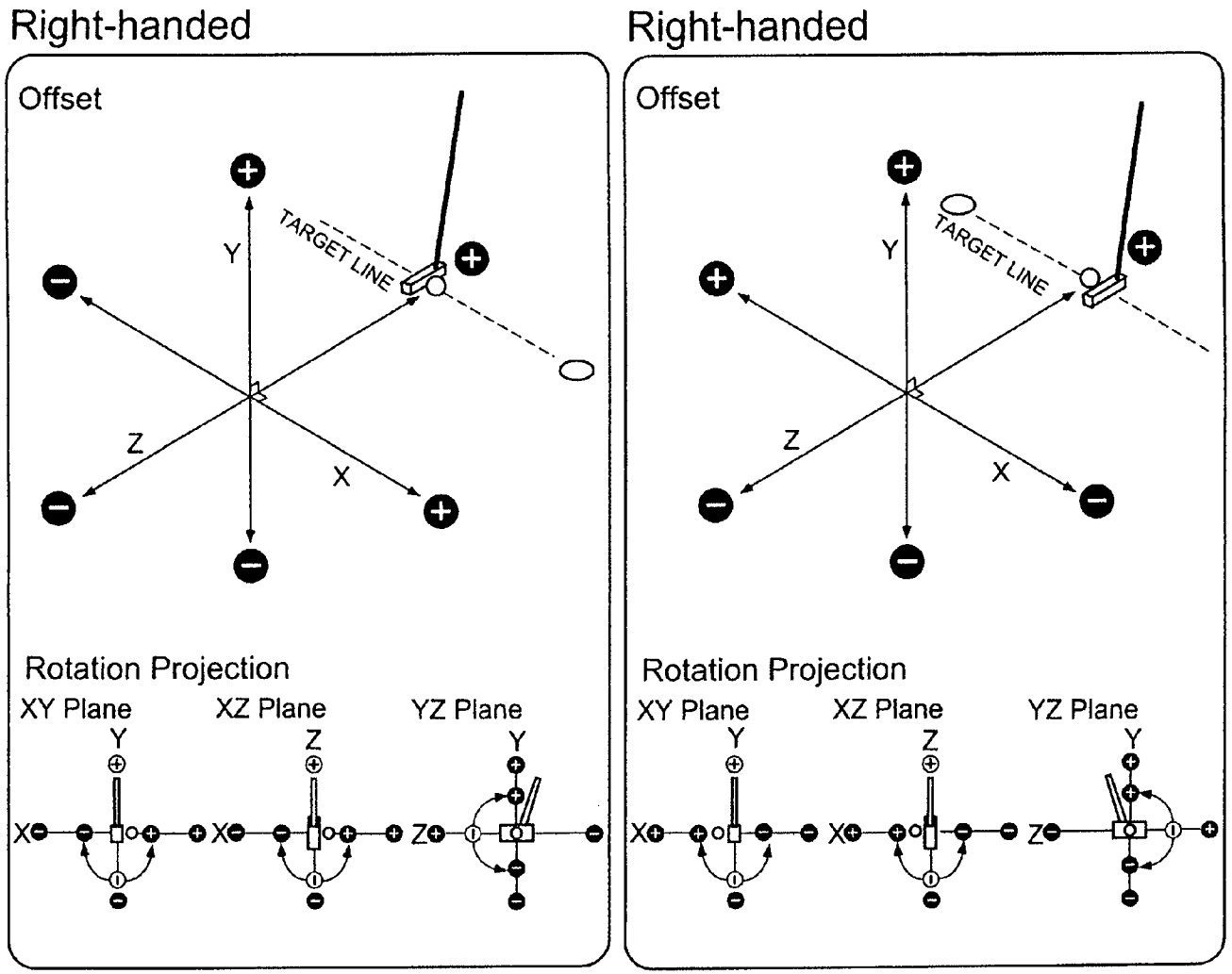
FIG. 7 shows positional data planes and the relationship of those planes to an object when determination of the object's position based on those planes is desired.

System algorithms calculate standard deviations for the X, Y, and Z coordinates of each filtered LED data sample collected over a previously recorded position (FIG. 7). LED positions are found through an iterative algorithm using initial estimates for the distance "Z" along path referenced as 30(*a*) in FIG. 1 between the camera and the first LED designated as 15(*a*). The initial search space is estimated based on the distance between the second LED designated as 15(*b*) and the third LED designated as 15(*c*). The iteration is as follows:

1. Select interval based on "Z" value for the first LED.
2. Calculate "Z" values for the second LED and the third LED.
3. Calculate the distance between the second LED and the third LED and subtract the known distance.
4. Repeat until an error function falls under an established tolerance.

Figure 5:
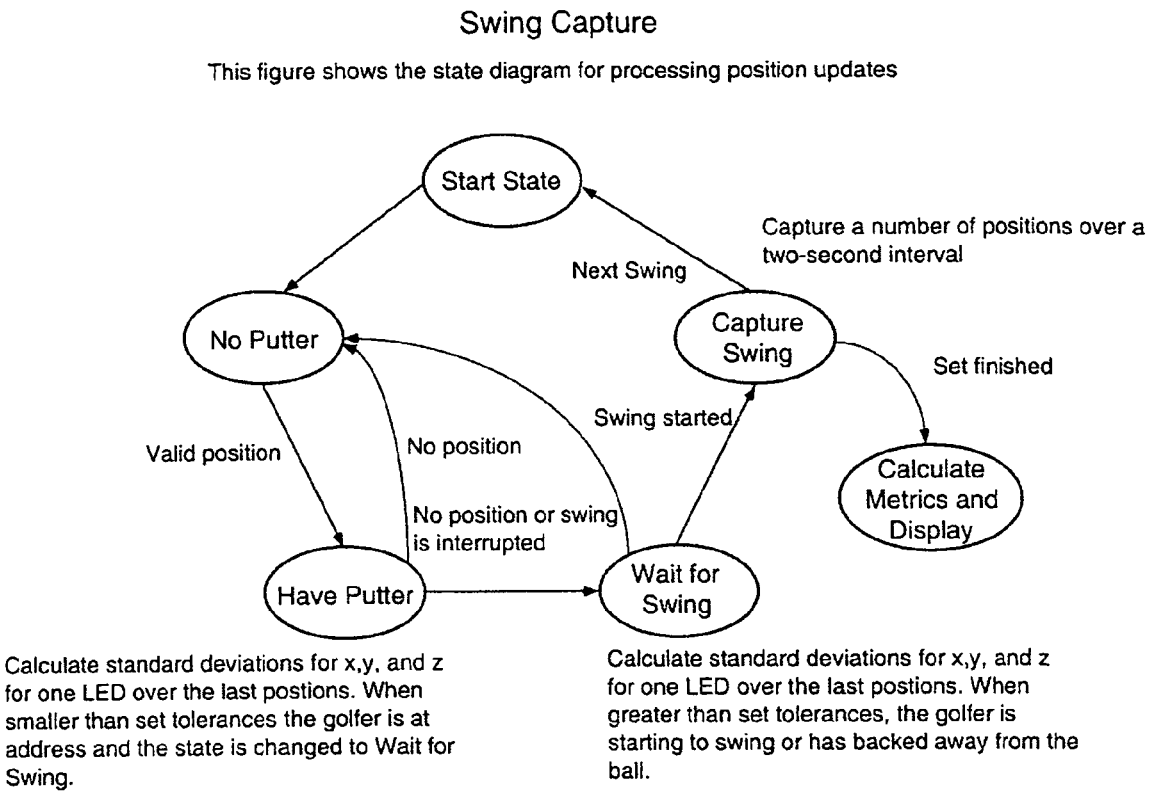
FIG. 5 shows a state diagram for processing position updates for the position determining apparatus when used as a golf-swing analysis tool.

FIG. 5 shows a preferred state diagram for stroke acquisition. The collection of positions for the stroke is based on "arming" acquisition based on the "stillness" of the putter. Accordingly, when the deviations for all LED coordinates are smaller than set tolerances for 200 milliseconds, a software test routine determines the status of the golfer as being at a "point of address" which establishes a "Start State", zero point, or reference frame for data collection and the "Start State" is changed to "Wait for Swing". The system then waits for the putter to become "unstill" and pulled back along the "X" axis (FIG. 7) in the direction of the backstroke (shown in FIG. 1A) within certain tolerances in the "Z" and "Y" axis (FIG. 7). The stillness function takes as parameters the number of strokes (N) to measure and the tolerances in each axis. In this regard, tolerance is the variance in each direction for the last (N) position acquisition.

For each movement of the club (putt stroke) or if the golfer has backed away from the ball, standard deviations for the X, Y, and Z coordinates for at least one LED over the last deviation measurement would be greater than set tolerances, i.e., those established at the state of "address" (reference step 155 in FIG. 6). At this point, the system is cued to collect data on the putt stroke in a circular buffer over an approximately two second time interval, as represented by "Capture Swing" in FIG. 5. Preferably, a successfully completed putt stroke is indicated by a beep sound from the receiver's speaker.

In one embodiment, as shown by the "Next Swing" arrow leading to the previously encountered "Start State", the golfer executes five putt stokes for which the above process is repeated. For each putt stroke, data collected in the circular buffer from the previous putt stroke is moved to temporary storage to make room for data collected on the putt stroke being currently executed. The previous putt stroke data located in temporary storage is made available/accessible for later use in stroke parameter analysis, display, and/or for data linked transfer to a local personal computer or similarly enabled device, or a remote site via the Internet (reference step 160).

In one embodiment, instead of using a stroke summary or an average of the combined five putt strokes, stroke parameters on all five individual putt strokes are made available and displayed via a software interface on the LCD touch screen 40 or remote monitor, as explained herein.

Upon completion of the five putt-stroke set, system algorithms calculate matrices and determine club position by solving the mathematical relationship between the physical position of the three LEDs 15(*a*)-(*c*) on the club shaft 50 (three centroid positions) to the projection of the LEDs onto the two-dimensional (2D) image plane of the camera 40 in the device housing. In this regard, a software controlled microprocessor converts the physical attributes of the stroke into a digital database, groups the data into evaluation profiles, and generates various reports, charts, and graphs relating to at least 8 parameters/matrices in the form of immediate real-time graphical feedback to a high resolution touch control screen in the receiver for swing-analysis viewing.

Initially, the following positions are preferably found: point at backstroke, point at follow through, point before impact and point after impact. The point before and after impact are determined by comparison from the address point which is the "stillness" point calculated above which is the mean position of (N) points before the acquisition is triggered.

Additional viewable feedback preferably includes club head speed/velocity and rotation, alignment at address, alignment and loft at impact, impact spot, and forward and backward stroke path (FIGS. 9-12). Twenty-two other parameters, although measured, are not made available to the end user.

As indicated above, the system 5 eliminates erroneous solution sets (ambiguity) associated with 3D-position determination as the receiver interpolates between the three LED data points. In this regard, reduction algorithms are used to analyze data coordinates along an X plane, a Y plane, and a Z plane to measure position for state of swing, capture, and record putter swing.

The present system 5, as described herein, differs from the closed form definitive formula calculation method (no ambiguity) utilized in "Machine Vision Robotics Technology" in that with only three LED data points collected, the position of the club in 3D cannot be determined from the 2D image without ambiguity. Therefore, the system includes techniques, i.e., predefined data source location and movement parameters coupled with reduction algorithms, which are employed to eliminate those erroneous solution sets.

In the case of putt-stroke analysis, the transmitter unit's unique construction, as described herein, positions the three LEDs 15(*a*)-(*c*) in such as way as to set movement parameters that account for club positioning and movement generally associated with a conventional putt-stroke and excludes all others outside the normal range of club movement.

Generally speaking, if the three data source locations of the position determining apparatus (LEDs, for example, in the case of a golf swing analysis tool) are known and those known positions are restricted to predefined movement parameters, ambiguous solutions sets resulting from movements outside or that exceed those predefined movement parameters can be eliminated through reduction algorithms so that only a single valid solution set remains for position determining analysis relating to the golf swing.

As indicated above, the issue of ambiguous solutions is solved in part through the design of the putter clip. First, two of the three LEDs 15(*a*) and 15(*b*) are positioned such that the line defined by the center of those LEDs runs parallel to the club shaft 50, i.e., the LEDs are vertical to each other. Typically, since the condition where the club shaft 50 is tilted beyond vertical never exists in the process of putting, the LED located on the lower portion of the shaft (LED 15(*a*)) is always closer to the camera than the LED higher up on the shaft (LED 15(*b*)). Thus, any ambiguity (solution set) associated with rotation toward or away from the camera 40 is eliminated. Furthermore, the third LED 15(*c*), positioned off the axis of the club shaft is offset behind the other two LEDs 15(*a*) and 15(*b*). In this regard, the third LED 15(*c*) is positioned along an arm 65 extending outward from the shaft 50 and backward in a direction generally opposite to the direction of data transmission so as to be farther from the receiver 35 than the first and second light emitting diodes 15(*a*) and 15(*b*), (see FIG. 2E). Accordingly, unless the club shaft 50 is rotated excessively, beyond that reasonably experienced during a stroke (greater than predefined movement parameters), then the ambiguity associated with rotation about the club shaft 50 is eliminated.

FIG. 7 shows positional data planes and the relationship of those planes to an object in which determination of position based on those planes is desired. In this regard, the X-plane is along the putter's stroke, the Y-plane is a positive value representing height (zero value is the ground and any negative value would be into the earth), and the Z-plane represents the distance to the camera. Accordingly, if plane z=0 is defined as the vertical plane that intersects the camera lens and is parallel to the target line of the putt, then the movement of the club is restricted to the space in front of the camera where z is greater than zero (z>0). Any solution sets that result in a club position behind the camera (z<0) can be rejected.

Figure 8:
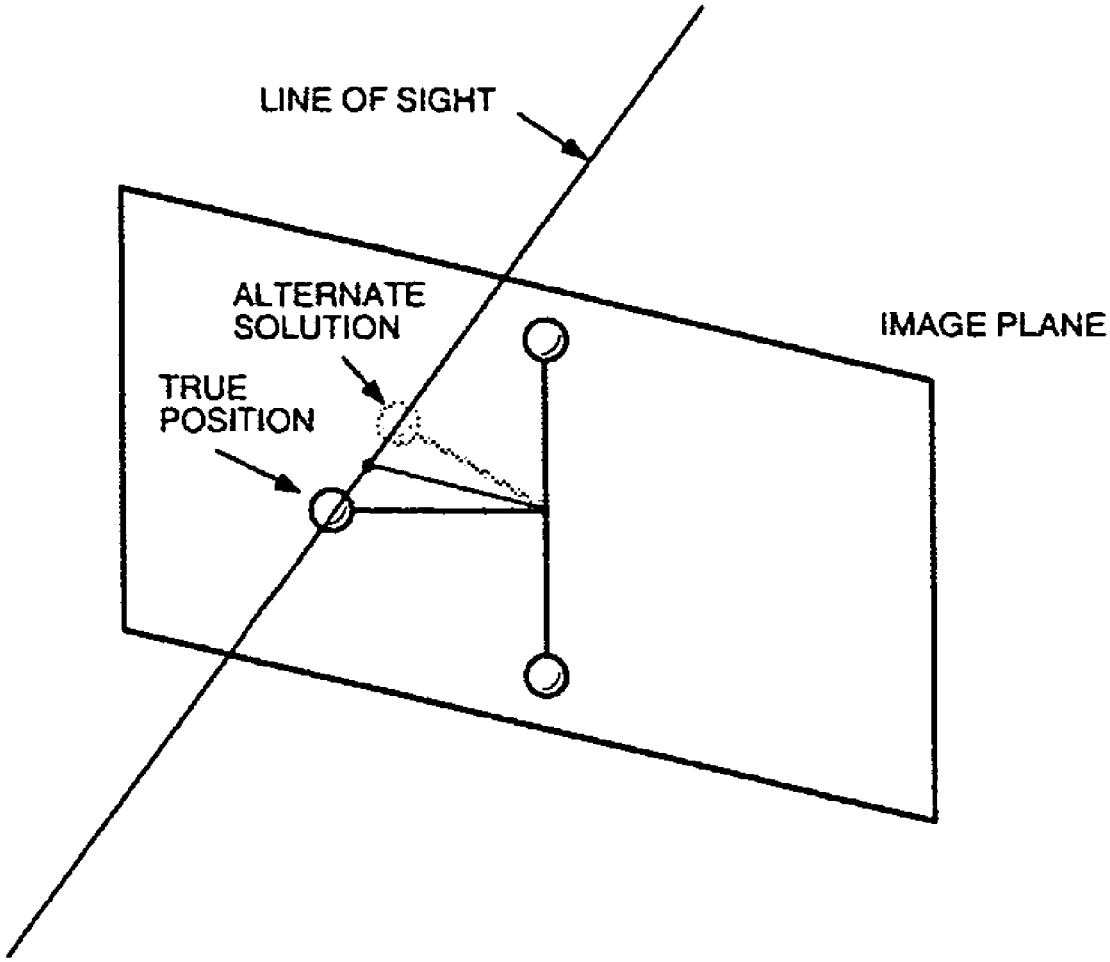
FIG. 8 shows the ambiguity associated with rotation of a club shaft when that rotation is projected onto the two-dimensional camera image.
Figure 9:
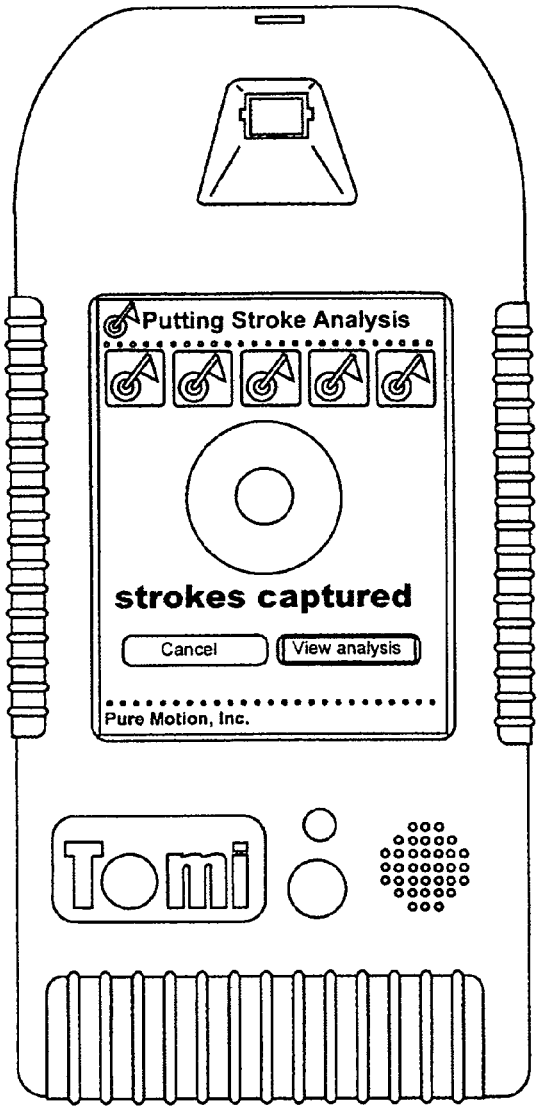
FIGS. 9-12 show examples of various reports, charts, and graphs relating to swing analysis parameters displayed on a high resolution touch control screen in one embodiment of the receiver for viewing.
Figure 10:
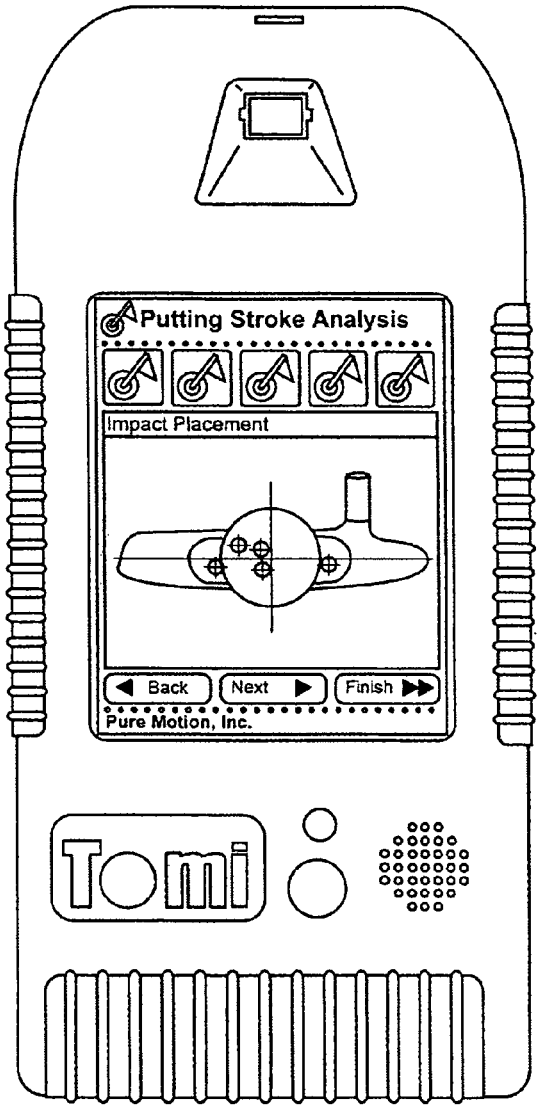
Figure 11:
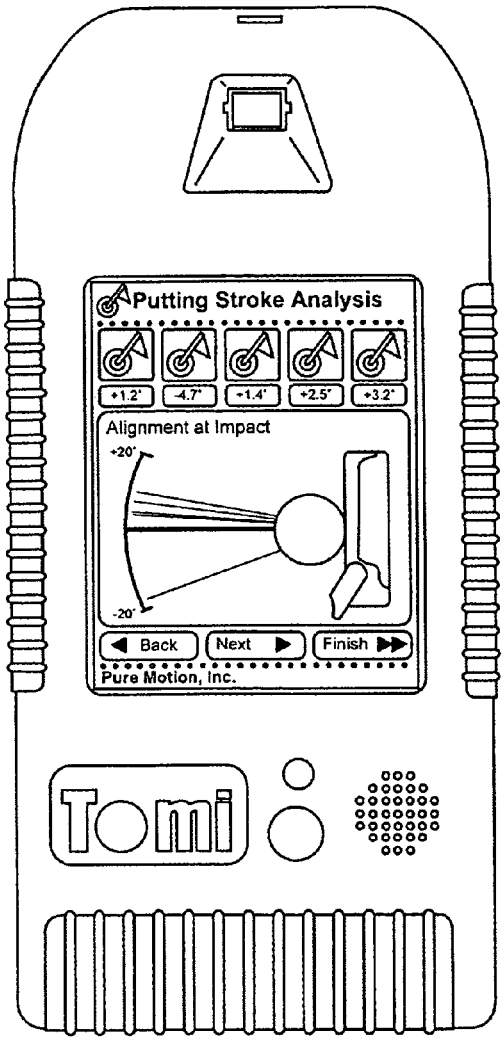
Figure 12:
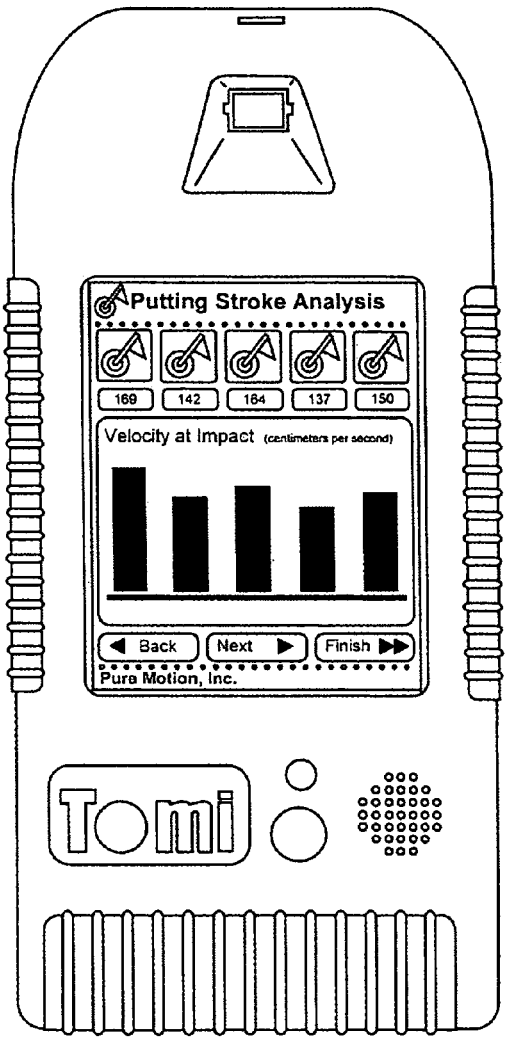

There are also ambiguities associated with rotation of the club shaft when that rotation is projected onto the 2D-camera image. For instance, FIG. 8 shows three reference points analogous to the LED positions of the club shaft. When the points are projected onto a 2D-image plane, the position of one of the reference points is ambiguous when there is rotation along the axis of the remaining two reference points. The case illustrated in FIG. 8, is the simplest case in point, but the ambiguous solution results for all axes of rotation.

In this regard, the system determines club rotation as follows:

1. Translate the position of the first LED (15(*a*)) to the coordinate system origin.
2. Project the second LED (15(*b*)) onto the XZ plane and calculate the angle ($TH_{xz}$) the projected point is from the Z axis.
3. Rotate the club about the Y axis so that the first LED and the second LED are along the Z axis. (Rotate the club $TH_{xz}$)
4. Rotate the club so that the first LED and the second LED are along the Y axis. This angle is "elevation".
5. Rotate the club back to its original orientation. (Rotate the club—$TH_{xz}$)
6. The absolute shaft rotation is determined by the position of the third LED (15(*c*)) versus the known position of the third LED when the club is orthogonal to the camera.
7. Adjust the rotation by rotation at the address point.

This process is illustrated mathematically below.

$$THxz=\tan((X_{LED1}-X_{LED2})/(Z_{LED1}-Z_{LED2}))^{-1}$$

$$\text{Translation}=\begin{bmatrix}-X_{LED1}\\-Y_{LED1}\\-Z_{LED1}\\1\end{bmatrix}\begin{bmatrix}1&0&0&0\\0&1&0&0\\0&0&1&0\\0&0&0&1\end{bmatrix}$$

For each LED:

$$\text{Rotation}Y=\begin{bmatrix}X\\Y\\Z\\1\end{bmatrix}\begin{bmatrix}\cos(\varnothing)&0&\sin(\varnothing)&0\\0&1&0&1\\-\sin(\varnothing)&0&\cos(\varnothing)&0\\0&0&0&1\end{bmatrix}$$

$$\text{Elevation}=\tan(\sqrt{(X_{LED1}-X_{LED2})^2+(Z_{LED1}-Z_{LED2})^2}+/(Y_{LED1}-Y_{LED2}))^{-1}$$

For each LED:

$$\text{RotationX} = \begin{bmatrix} X \\ Y \\ Z \\ 1 \end{bmatrix} \begin{bmatrix} 1 & 0 & 0 & 0 \\ 0 & \cos(\varnothing) & \sin(\varnothing) & 0 \\ 0 & -\sin(\varnothing) & \cos(\varnothing) & 0 \\ 0 & 0 & 0 & 1 \end{bmatrix}$$

Then rotate around Y -THxz $$\text{RotationY} = \begin{bmatrix} X \\ Y \\ Z \\ 1 \end{bmatrix} \begin{bmatrix} \cos(\varnothing) & 0 & \sin(\varnothing) & 0 \\ 0 & 1 & 0 & 0 \\ -\sin(\varnothing) & 0 & \cos(\varnothing) & 0 \\ 0 & 0 & 0 & 0 \end{bmatrix}$$

Other parameters are determined as follows:

Loft

1. Translate the first LED (15(*a*)) to origin.
2. Rotate about Y the angle calculated for impact rotation.
3. Project the second LED (15(*b*)) to the YX plane and measure the angle from the Y axis.

Angle at Impact

1. Calculate position at impact by interpolating a position between the point before impact and the point after impact.
2. Calculate rotation.

Velocity at Impact

1. Calculate the distance between the point before impact and the point after impact.
2. Multiply by 30 to get velocity in seconds.

Impact Spot

1. The impact spot is the difference between the point of impact and the point of address.

Alignment at Address

1. The alignment at address is the rotation at the "stillness" point.

Persons of ordinary skill in the art will understand that the techniques described herein as they relate to position determination in a golf club are equally adaptable to other activities such as tennis, baseball, hockey, fencing, etc. Even in the context of the golf club position data collection and analysis, persons of ordinary skill in the art will understand that the placement or location of the three LEDs are not restricted to those described above. The LEDs may be positioned virtually anywhere on the club shaft so long as those known LED positions are coupled with predefined movement parameters and reduction algorithms which account for those predefined movements resulting in the elimination of ambiguous solution sets relating to club positioning.

As indicated above, various reports, charts, and graphs relating to a variety of putt-stroke parameters are made available for viewing via user interface on a high-resolution touch control screen in the receiver. The receiver's interface functions much like a handheld PDA. As shown in FIGS. 9-12, various displays with touch screen controls are made available for data input, control, and navigation from one display to another. Such displays include a main menu that permits entry of user specific information and help menu access. Other interfaces are made available to display the various putt stroke parameters disclosed herein.

Accordingly, as described in more detail herein, a method for determining the relative displacement of a rigid object may include the following steps: (1) providing three data sources to transmit data relating to the positional displacement of an object; (2) providing a receiver to receive the data transmitted by the data sources; (3) positioning the data sources on the object; (4) predefining movement parameters of the data sources based on the positioning of the data sources on the object; (5) transmitting the data from the data sources; (6) receiving the data from the data sources by the receiver; (7) eliminating data that exceeds the predefined movement parameters so that a single valid solution set representing the positional displacement of the object remains; and (8) displaying information relating to the remaining positional displacement data.

As described herein, in one embodiment, positional displacement information relating to the object may be stored in system memory for later use. The stored information may be uploaded via cable hardwire, or wireless via Bluetooth™ or Wi-Fi technology to the Internet for further transmission to a remote site.

Alternative embodiments of the transmitter and receiver are shown in FIGS. 13 and 14. In this embodiment, the receiver unit is preferable wired directly or wirelessly to a computer monitor, television screen, or other viewing means to view stroke parameters. The receiving unit may further include a memory card, disc or other data storage means that may be removed from the receiver, inserted into a compatible device for viewing recorded data, images, and other information for use in at least stroke analysis.

In other embodiment, reflector based technology may be utilized in which the transmitter LEDs are replaced with reflectors and a single light source emanates from the receiver so as to be reflected back to the receiver where the techniques described herein determine the positional location of the reflectors by transforming the projected data locations in the camera image to 3D coordinates.

The apparatus and methods of the present invention have been described with some particularity, but the specific designs, constructions and steps disclosed are not to be taken as delimiting of the invention. Obvious modifications will make themselves apparent to those of ordinary skill in the art, all of which will not depart from the essence of the invention and all such changes and modifications are intended to be encompassed within the appended claims.

What is claimed is:

1. An apparatus for determining the relative displacement of a golf putter, comprising:

a transmitter unit; and a receiver unit;

wherein the transmitter unit is removably attached to a putter shaft, the transmitter unit includes a first, a second, and a third light emitting diode for transmitting positional data relating to the putter to the receiver, the first diode is positioned above the second diode such that a line defined by the center of the first and the second diodes is vertical to each other, the third diode is positioned along an arm extending outward from the putter shaft and backward in a direction generally away from the direction of data transmission so as to be farther from the receiver than the first and second light emitting diodes, the diodes having predefined movement parameters based on the position of each diode on the golf putter; and wherein the receiver unit includes:

an optical receptor to collect the data from each diode; and a processor for processing the data to provide a single valid solution set generated in part by eliminating positional movements that exceed the predefined movement parameters a display for viewing the valid solution set for the purpose of at least stroke analysis.

2. The apparatus of claim 1, further comprising:

three data sources positioned on an object, the data sources configured to transmit data relating to positional displacement of the object, each data sources having predefined movement parameters based on the position of each data source on the object; and a receiver unit for receiving the data relating to positional displacement from each data source, and a processing means for processing the data to provide positional information representing a single valid solution set generated in part by eliminating positional movements that exceed the predefined movement parameters.

3. The apparatus of claim 2, wherein the receiver unit is configured to display positional information relating to the object.

4. A method for determining the relative displacement of a golf putter, comprising the steps;

providing the apparatus of claim 1;

providing three data sources to transmit data relating to the positional displacement of an object;

providing a receiver to receive the data transmitted by the data sources;

positioning the data sources on the object;

predefining movement parameters of the data sources based on the positioning of the data sources on the object;

transmitting the data from the data sources;

receiving the data from the data sources be the receivers;

eliminating data that exceeds the predefined movement parameters so that a single valid solution set representing the positional displacement of the object remains; and displaying information relating to the remaining positional displacement data.

* * * * *

UNITED STATES PATENT AND TRADEMARK OFFICE

CERTIFICATE OF CORRECTION

PATENT NO. : 7,499,828 B2
APPLICATION NO. : 11/606248
DATED : March 3, 2009
INVENTOR(S) : Barton et al.

It is certified that error appears in the above-identified patent and that said Letters Patent is hereby corrected as shown below:

In Column 2, Line 51, “eliminated” should be -- eliminate --;
In Column 4, Line 1, “detail” should be -- detailed --;
In Column 7, Lines 36-37, “furthers” should be -- further --;
In Column 12, Line 24, “preferable” should be -- preferably --;
In Column 12, Line 31, “embodiment” should be -- embodiments --;

Claim no. 2, in Column 13, Line 10, “sources” should be -- source --;

Claim no. 4, in Column 14, Line 2, the semi-colon should be a colon;
Claim no. 4, in Column 14, Line 15, “be” should be -- by --;
Claim no. 4, in Column 14, Line 15, “receivers” should be -- receiver --.

Signed and Sealed this

Fourth Day of August, 2009

John Doll

JOHN DOLL
*Acting Director of the United States Patent and Trademark Office*